United States Patent [19]

Tomoyori et al.

[11] Patent Number: 5,049,905

[45] Date of Patent: Sep. 17, 1991

[54] IMAGE FORMING METHOD, EXPOSURE METHOD, IMAGE FORMING APPARATUS AND DEPOSITED TONER LAYER CONTROL APPARATUS

[75] Inventors: Makoto Tomoyori, Iwate; Keiichi Akiyama, Tamayama, both of Japan

[73] Assignee: Alps Electric Co., Ltd., Tokyo, Japan

[21] Appl. No.: 142,841

[22] Filed: Jan. 11, 1988

[30] Foreign Application Priority Data

| | | | |
|---|---|---|---|
| Mar. 16, 1987 | [JP] | Japan | 62-59027 |
| Mar. 16, 1987 | [JP] | Japan | 62-59028 |
| Mar. 16, 1987 | [JP] | Japan | 62-59029 |
| Mar. 16, 1987 | [JP] | Japan | 62-59031 |

[51] Int. Cl.[5] ..... G03G 15/00; G03G 15/08

[52] U.S. Cl. ..... 346/153.1; 355/220; 355/229; 355/273; 355/274

[58] Field of Search ..... 355/3 TR, 14 TR, 3 DR, 355/3 BE, 3 R, 14 E, 273, 274, 220, 229; 346/153.1, 155, 160

[56] References Cited

U.S. PATENT DOCUMENTS

| | | | |
|---|---|---|---|
| 3,986,872 | 10/1976 | Giaimo, Jr. | 355/210 X |
| 4,219,271 | 8/1980 | Ohkubo et al. | 355/14 R |
| 4,461,563 | 7/1984 | Favata | 355/3 TR |
| 4,579,440 | 4/1986 | Katoh | 355/3 TR X |
| 4,580,889 | 4/1986 | Hiranuma et al. | 355/3 TR X |
| 4,637,708 | 1/1987 | Yuasa | 355/212 |
| 4,714,939 | 12/1987 | Ahern et al. | 355/3 TR |
| 4,743,939 | 5/1988 | Dulmage et al. | 355/3 TR |

*Primary Examiner*—A. C. Prescott

*Attorney, Agent, or Firm*—Guy W. Shoup; Norman R. Klivans

[57] ABSTRACT

An image forming method and apparatus using an electronic photographic technology to form an image on a recording medium is configured to deposit toner on the entire surface of a toner carrier then reduce the adhesion corresponding to an image to be formed among toner deposited on the toner carrier before transferring the toner corresponding to the image to the recording medium.

6 Claims, 3 Drawing Sheets

IMAGE FORMING METHOD, EXPOSURE METHOD, IMAGE FORMING APPARATUS AND DEPOSITED TONER LAYER CONTROL APPARATUS

FIELD OF THE INVENTION

This invention relates to an image forming method, exposure method, image forming apparatus and deposited toner layer control method for forming an image on a recording medium, using an electric photographic technology, etc.

BACKGROUND OF THE INVENTION

An exemplary prior art image forming apparatus of this type is configured as shown in FIG. 6.

The prior art system uses an endless organic photoconductive (OPC) belt 1 as a sensitized member. The OPC belt 1 is supported by small rollers 2, 2, large roller 3 and driving roller 4 all located at the back thereof, and is driven by the driving roller 4 in an arrow-marked direction in FIG. 6. Various components are located around the OPC belt 1 to form an image on paper or other recording medium. More specifically, one surface of the OPC belt 1 is electrified with an even positive potential by a corona charging operation of an electrifier 5. Subsequently, a photographic writing unit 6 writes an electrostatic latent image exhibiting a print pattern on the OPC belt 1, and a developing unit 7 forms a toner image on the OPC belt 1 by selectively depositing negative-electrified toner to the electrostatic latent image. When the toner image reaches a transfer unit 8 as the OPC belt 1 travels, an electrostatic attraction force of the transfer unit 8 causes the toner image to be transferred from the OPC belt 1 to a sheet of paper 9 to form a final image thereon. After this, the paper 9 is detached from the OPC belt 1 and transported to a fixing unit 10 which fixes the toner image on the paper 9 under a certain heat or pressure. The paper 9 is subsequently discharged to a discharge tray (not shown). The OPC belt 1, passing through the transfer unit 8, is cared of by a deelectrifier 11 to remove a residual charge therefrom and by a cleaner 12 to remove residual toner therefrom.

In the prior art system, however, although the electrostatic latent image written on the OPC belt 1 by the photographic writing unit 6 is formed under an excellent high resolution, the toner often adheres to the OPC belt 1 other than the electrostatic latent image thereon, resulting in a low resolution toner image on the OPC belt 1 and a low resolution final image on the paper 9. That is, it often provides a low printing quality.

In order to improve the resolution in development by the developing unit 7, a strict control is required about the bias voltage of the developing unit 7, electrification degree of the toner, the gap between the developing unit 7 and the OPC belt 1, etc., and this invites a complicated structure of the system and requires a careful maintenance.

Additionally, around the OPC belt 1 must be provided a lot of parts or members such as photographic writing unit 6, developing unit 7, transfer unit 8, deelectrifier 11 and cleaner 12, and they invite a complicated, large-scaled structure of the entire system.

OBJECT OF THE INVENTION

It is therefore an object of the invention to provide an image forming method and apparatus capable of forming an image under a high resolution which contributes to a high-quality print and capable of diminishing and simplifying the entire arrangement which contributes to a cost reduction.

SUMMARY OF THE INVENTION

An image forming method which is a first aspect of the invention is characterized in depositing toner on the entire surface in a transfer image forming area on a toner carrier, subsequently reducing the toner adhesion force under which the toner on a transfer image corresponding to an image to be finally formed adheres to the toner carrier, and subsequently transferring the toner having a reduced adhesion force to a recording medium to form a final image thereon.

An image forming apparatus which is a second aspect of the invention is characterized in the use of a toner carrier, a toner depositing mechanism configured to deposit toner on the entire surface in a transfer image forming area on the toner-carrier, a transfer image forming mechanism configured to reduce the toner adhesion force under which the toner on the transfer image position corresponding to an image to be finally formed adheres to the toner carrier, and a transfer unit configured to transfer the toner having a reduced adhesion force from the transfer image position to a recording medium.

When the second-aspect image forming apparatus is activated according to the first-aspect image forming method, a high-quality print is accomplished under a high resolution.

More specifically, toner is deposited on the entire surface in a transfer image forming area on the toner carrier by the toner depositing mechanism. Subsequently, the transfer image forming mechanism decreases the toner adhesion force under which the toner on the transfer image position corresponding to an image to be finally formed adheres to the toner carrier. After this, the transfer unit transfers the toner having a reduced adhesion force to the recording medium to finally form a high-resolution image on the recording medium.

An image forming method which is a third aspect of the invention is characterized in electrifying the entire surface in a transfer-image forming area of an endless sensitized member while the sensitized member moves by one rotation, subsequently depositing opposite-electrified toner on the electrified surface of the sensitized member under a Coulomb force, subsequently reducing the Coulomb force between the sensitized member and the toner on the transfer image position corresponding to an image to be finally formed, subsequently transferring the toner having a reduced Coulomb force to a recording medium to form a final image thereon, electrifying the toner so as to invert the electrified potential of the toner adhering to the sensitized member, removing the potential-inverted toner from the sensitized member and deelectrifying the sensitized member.

An image forming apparatus which is a fourth aspect of the invention is characterized in the use of an endless sensitized member, an electrifier configured to electrify the sensitized member with a positive potential and electrify negative-potential residual toner adhering to the sensitized member to a positive potential, a developing unit configured to deposit negative-potential toner to the positive-electrified sensitized member and remove the positive-electrified residual toner from the sensitized member, an exposure unit configured to deelectrify the transfer-image position on the sensitized member corresponding to an image to be formed by exposing the sensitized member to light and configured to deelectrify the residual potential on the sensitized member, and a transfer unit configured to transfer the toner from the transfer-image position of the sensitized member to a recording medium.

When the fourth-aspect image forming apparatus is activated according to the third-aspect image forming method, a high-quality print is accomplished under a high resolution.

More specifically, while the sensitized member moves by one rotation, the following operations are effected. Firstly, the entire surface in the transfer-image forming area of the sensitized member is electrified with a positive potential by the electrifier, and while the electrified area of the sensitized member passes through the developing unit, negative-electrified toner is deposited on the entire electrified surface of the sensitized member under a Coulomb force. Subsequently, the exposure unit exposes the transfer-image position on the sensitized member corresponding to an image to be formed and deelectrifies the same position of the sensitized member to reduce the Coulomb force against the toner. The transfer unit subsequently transfers the toner having a reduced Coulomb force from the transfer-image position of the sensitized member to the recording medium to finally provide a high-resolution image on the recording medium.

After this, while the sensitized member is driven by another rotation, the following operations are effected. More specifically, negative-potential residual toner still remaining on the sensitized member is electrified with a positive potential by the electrifier, and the positive-electrified residual toner is removed from the sensitized member for storage for a subsequent use. After this, the sensitized member is exposed to light by the exposure unit to deelectrify the residual potential on the sensitized member.

A sensitized member exposure method which is a fifth aspect of the invention is characterized in exposing a sensitized member having a ready-for-electrification surface to light entering from the back of the sensitized member to control the electrification of the sensitized member surface.

According to the fifth aspect of the invention, the sensitized member is exposed to light entering from the back thereof to change the potential of the exposed surface to zero for the purpose of controlling the electrification of the sensitized member surface. Therefore, the sensitized member provided with toner on the surface thereof can be exposed to light from the back thereof, and the light is never prevented by the toner. The surface potential of the exposed portion of the sensitized member is changed to zero so that the adhesion force of the toner deposited on the sensitized member due to a Coulomb force is reduced to a degree enabling image transfer. Further, when the sensitized member is exposed throughout the entire surface thereof, the entire surface of the sensitized member is deelectrified.

A toner film control apparatus which is a sixth aspect of the invention is characterized in the use of a bias member configured to generate a Coulomb force between a toner carrier and toner deposited on the surface thereof so as to detach toner existing outside a toner film adhering to the surface of the toner carrier in a uniform thickness.

The toner film control apparatus according to the sixth aspect of the invention never fails to form a toner film of an even thickness on the toner carrier when toner first deposited on the surface of the toner carrier exhibits an uneven thickness, by detaching part of the toner existing outside a single-layered or multi-layered uniform toner film under a Coulomb force generated between the toner and the bias member while maintaining the uniform base toner film adhering to the toner carrier.

BRIEF DESCRIPTION OF THE DRAWINGS

FIGS. 1 and 2 show an image forming apparatus embodying the invention, in which: FIG. 1 is an entire arrangement view; and FIG. 2 is a front elevation showing an exposure unit;

DETAILED DESCRIPTION

The invention is described below, referring to an embodiment illustrated in FIGS. 1 through 3.

Figure 1:
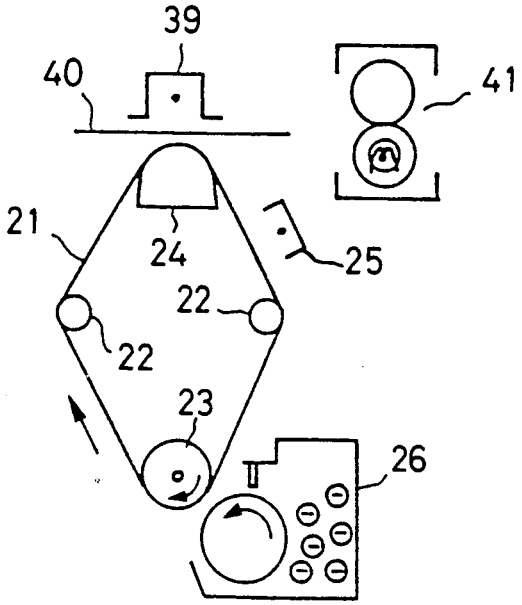
Figure 2:
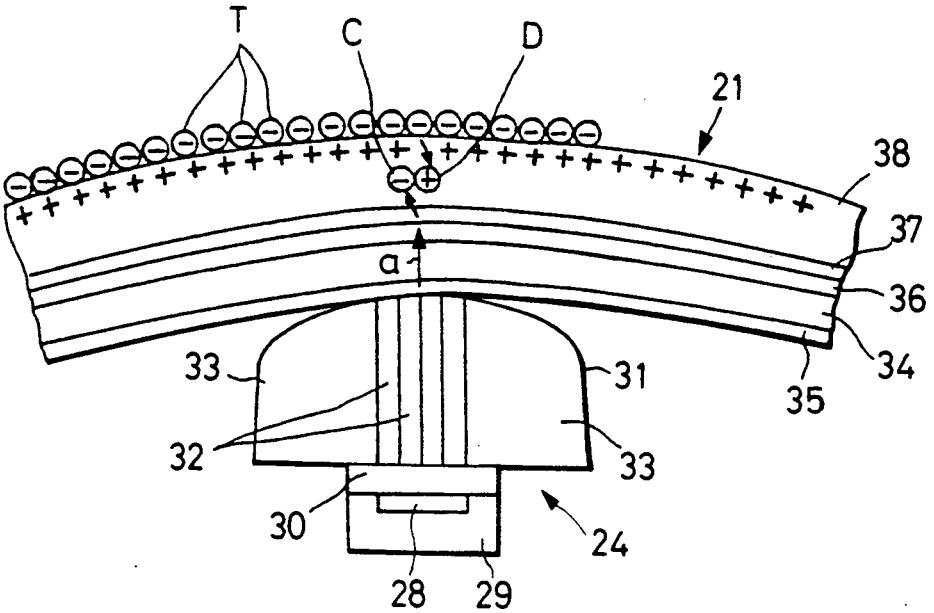

FIGS. 1 and 2 show an embodiment of an image forming apparatus according to the invention.

FIG. 1 shows the entire arrangement of the embodiment using an endless OPC (organic photoconductive) belt 21 as a sensitized member. The OPC belt 21 is supported by small rollers 22, 22, driving roller 23 and exposure unit 24 all mounted at the back thereof, and is driven by the driving roller 23 in the arrow-marked direction. Around the OPC belt 21 are mounted other components or parts. More specifically, an electrifier 25 is provided upstream of the exposure unit 24 with respect to the travelling direction of the OPC belt 21 to positively corona-charge the entire surface of a transfer-image forming area on the surface of the OPC belt 21 during a first full rotation of the OPC belt and to positively corona-charge residual negative-potential toner adhering to the surface during a subsequent full rotation of the OPC belt 21. A develop unit 26 is mounted between the electrifier 25 and the exposure unit 24 to deposit negative-potential toner T on the positive-potential surface of the OPC belt 21 under a Coulomb force between them during a first full rotation of the OPC belt 21. During a subsequent full rotation of the OPC belt 21, residual toner positive-electrified by the electrifier 25 and remaining on the OPC belt 21 is taken back to the developing unit 26 by a negative-biased magnetic brush, for example, to clean the surface of the OPC belt 21. The exposure unit 24 exposes the OPC belt 21 to light during a first full rotation of the OPC belt 21 to reduce the adhesion force of toner T on a transfer image corresponding to an image to be finally formed among the toner uniformly deposited substantially throughout the entire surface of the OPC belt by the developing unit 26. During another full rotation of the OPC belt 21, the exposure unit 24 removes all residual potential on the surface of the OPC belt 21. The exposure unit 24 is mounted in close contact with the back surface of the OPC belt 21 as shown in FIG. 2. The exposure unit 24 in this embodiment comprises a light emitting diode (LED) assembly 29 having an LED 28 for emitting light in response to a print instruction and a fiber plate 31 integrally connected thereto via a transparent resin member 30. The fiber plate 31 includes a group of optical fibers 32 configured to directly conduct light emitted by the LED 28 to the back surface of the OPC belt 21 and protective glass members 33, 33 sandwichingly supporting the optical fibers 32 from opposite sides thereof. Surfaces of the flock of optical fibers 32 and protective glass members 33 are planished into arcuate surfaces to decrease frictional resistances between the OPC belt 21 and themselves. The OPC belt 21, as shown in FIG. 2, consists of a transparent base film 34 as a support sheet, a transparent hardwearing layer 35 provided at the back of the base film 34 to slidably contact the exposure unit 24, a transparent electrode 36 provided on the front surface of the base film 34 to lead charges to ground, a carrier generating layer 37 provided on the transparent electrode 36 to produce a negative-potential carrier C at the portion exposed to light from the exposure unit 24, and a carrier transmission layer 38 provided on the carrier generation layer 37 and positively electrified along the surface portion thereof by the electrifier 25 to move the carrier C generated by the carrier generation layer 37 to the surface portion thereof. This embodiment further uses a transfer unit 39 opposed to the exposure unit 24 from the surface side of the OPC belt 21 and located apart from the surface of the OPC belt 21 by a distance. While a sheet of paper 40 passes through between the transfer unit 39 and the OPC belt 21, the transfer unit 39 electrostatically transfers to the paper 40 the toner T on the transfer image position alone which was reduced in its adhesion force against the OPC belt 21 due to exposure to light by the exposure unit 24, and forms a toner image on the paper 40. Along the travelling direction of the paper 40 is provided a fixing unit 41 which fixes the toner image on the paper 40.

The image forming apparatus shown in FIGS. 1 and 2 operates as follows.

On receipt of a print instruction, the driving roller 23 first rotates in the arrow-marked direction in FIG. 1 to move the OPC belt 21 in the arrow-marked direction.

During a first full rotation of the OPC belt 21, the following operations are effected.

Firstly, the entire area in a transfer-image forming region on the surface of the OPC belt 21 is positively electrified by a corona-charging action of the electrifier 25. Subsequently, while the electrified portion passes through the developing unit 26 at the next stage, negatively electrified toner T is deposited uniformly. The toner T is deposited as explained below in detail, referring to FIG. 2. The surface portion of the carrier transmission layer 38, which is the uppermost layer of the OPC belt 21, is already electrified with a positive potential due to the corona charging action of the electrifier 25. A Coulomb force generated between the surface portion and the negative-potential toner T causes the toner T to be attracted toward the carrier transmission layer 38 into a uniform adhesion to the surface of the carrier transmission layer 38. The toner T adhering to the surface of the carrier transmission layer 38 forms a single layer or multiple layers (single layer in this embodiment).

After this, as the OPC belt 21 travels, the toner T deposited on the surface of the OPC belt 21 reaches the exposure unit 24. The exposure unit 24 then emits light selectively toward the OPC belt 21 in order to form a transfer image corresponding to the print instruction. More specifically, the light emitted from the LED 28 of the exposure unit 24 passes through the transparent resin member 30 and optical fibers 32 and enters in the interior of the OPC belt 21 through the hardwearing layer 35 thereof. The light further passes through the base film 34 and the electrode 36 as shown by arrow a in FIG. 2 and reaches the carrier generation layer 37 to expose the transfer-image forming portion of the carrier generation layer 37. In the carrier generation layer 37, a negative carrier C is produced from the light-exposed portion thereof. In the next carrier transmission layer 38, the negative-potential carrier C and a positive-potential charge D at the surface portion pull each other and move in the opposite directions for electrical neutralization. When the positive-potential charge D along the surface of the carrier transmission layer 38 disappears in this fashion, the Coulomb force causing adhesion of the toner T at this portion disappears and changes the toner T at this portion into a transfer image which can be transferred. In the remainder portion which was not exposed, the toner T maintains adhesion to the surface of the carrier transmission layer 38 under a sufficiently large Coulomb force. By the exposure operation of the exposure unit in this fashion, a transfer image consisting of the toner T having a reduced adhesion force against the OPC belt 21 is formed in the area of the toner T along the surface of the OPC belt 21. This transfer image has an excellent resolution.

Since the embodiment includes the transfer unit 39 opposed to the exposure unit 24, just when the transferable transfer image is formed along the surface of the carrier transmission layer 38 as described above, the negative-potential toner T adhering to the transfer-image position of the carrier transmission layer 38 is attracted toward the transfer unit 39 due to a positive bias voltage thereof, and is transferred to the surface of the paper 40 located midway to form a toner image thereon. Since the toner image on the paper 40 is formed by transferring the transfer image in the original form which was formed along the surface of the carrier transmission layer 38 of the OPC belt 21 under a high resolution, the toner image also maintains a high resolution.

After this, the paper 40 is detached from the OPC belt 21 and transported to the fixing unit 41. After the fixing unit 41 fixes the toner image, the paper 40 is discharged to a discharge tray (not shown).

While the OPC belt 21 travels another full rotation after passing through the transfer unit 39, the following operations are effected.

The toner T not transferred to the paper 40 at the transfer unit 39 remains on the OPC belt 21 as a residual toner and travels together with the OPC belt 21. The residual toner is inverted from a negative potential into a positive potential due to a corona charging action of the electrifier 25. The positive-electrified residual toner on the OPC belt 21 is attracted by the negative-biased magnetic brush at the developing unit 26 and taken in the interior of the developing unit 26. That is, the residual toner is completely removed from the surface of the OPC belt 21. The OPC belt 21, after cleaned in this fashion, is exposed to light to partly remove a residual potential while passing through the exposure unit 24 as it was when the transfer image was formed, and is further moved for a subsequent printing operation.

As described, the invention provides a high-resolution image on the paper 40. Further, since the electronic photographic process is effected while the OPC belt 21 is rotated, the deelectrifier 11 and the cleaner 12 both used in the prior art system may be omitted to provide a simplified arrangement which leads to a scale reduction of the entire system. Additionally, since the toner adhesion to the surface of the OPC belt 21 by the developing unit 26 is effected against the entire area in the transfer-image forming range, minor accuracies of the developing unit 26 may be acceptable as compared to the prior art system.

In the aforegoing embodiment, the exposure unit 24 and the transfer unit 39 are opposed to each other so as to form and transfer the transfer image at the same time substantially. However, the transfer unit 39 may be located downstream of the exposure unit 24 in the travelling direction of the OPC belt 21 so as to slightly delay the transfer operation with respect to formation of the transfer image.

Figure 3:
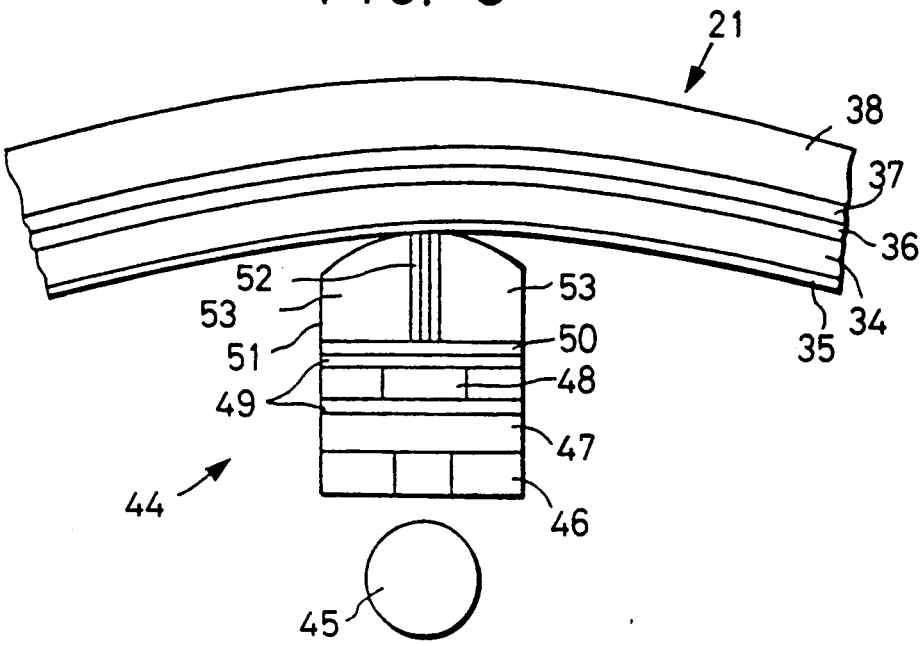
FIG. 3 is a front elevation of a further embodiment of the exposure unit.

FIGS. 3 shows a further embodiment of the exposure unit 24. The exposure unit 24 includes a liquid crystal shutter array head 44 (hereinafter called "LCS head") to optically write an image on the OPC belt 21. More specifically, light emitted from a light source 45 such a usual lamp, etc. is entered in the interior of the LCS head 44 through a light guide 46 thereof. After this, the entered light passes through a protective glass 47 and through a liquid crystal segment selectively changed to a light conductive condition by controlling electrical conduction of transparent electrodes at opposite sides among an LCS cell 48. Subsequently, the entered light sequentially passes through a transparent protective layer 50 made from an adhesive material and a group of optical fibers 52 of a fiber plate 51 into the interior of the OPC belt 21 so as to be used to form a transfer image corresponding to a print instruction. In the fiber plate 51, the group of optical fibers 52 is sandwichingly supported by protective glass members 53, 53 from opposite sides thereof, and its surfaces of the groups of optical fibers 52 and protective glass members 53, 53 contacting the OPC belt 21 are planished into arcuate surfaces.

The exposure unit 24 shown in FIGS. 2 or 3 contacts the back surface of the OPC belt 21 to effect photographic writing. However, also when the exposure unit 24 is positioned apart from the back surface of the OPC belt 21, it performs a satisfactory photographic writing. Further, both embodiments use transparent electrodes 36 and 49. However, they may be replaced by translucent electrodes in the form of thin films of aluminum or similar material which ensure a satisfactory light transmission.

Further, the exposure unit 24 may be located at the front surface side of the OPC belt 21 so that it exposes and deelectrifies the surface of the carrier transmission layer 38 beyond the toner T thereon to form a transfer image. In this case, the transfer unit 39 is located downstream of the exposure unit 24 in the travelling direction of the OPC belt 21. Also, the OPC belt 21 employed as the toner carrier may be replaced by a usual sensitized drum.

Figure 4:
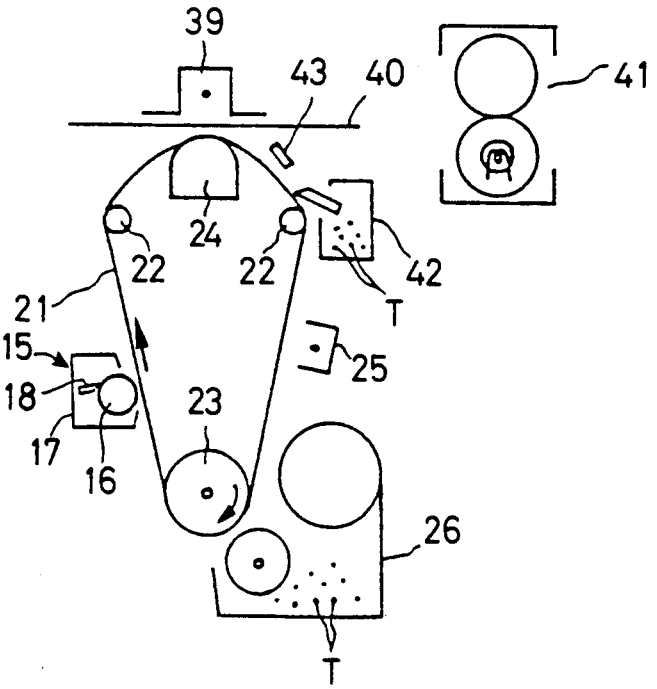
FIG. 4 is an entire arrangement view showing an embodiment of an image forming apparatus for mounting a toner film control apparatus.

FIG. 4 shows a deposited toner layer control apparatus 15 which is an embodiment of the invention and shows an image forming apparatus in which the deposited toner layer control apparatus 15 is mounted.

The image forming apparatus is first explained below. The apparatus uses an endless OPC belt 21, a kind of sensitized members, as a toner carrier. The OPC belt 21 is supported by small rollers 22, 22, driving roller 23 and photographic writing head 24 all mounted at the back thereof, and is driven by the driving roller 23 in the arrow-marked direction. Around the OPC belt 21 are mounted other components or parts. More specifically, a toner depositing mechanism is provided upstream of the photographic writing head 24 with respect to the travelling direction of the OPC belt 21 to deposit toner on the entire area in a transfer-image forming range on the surface of the OPC belt 21. In this embodiment, the toner depositing mechanism consists of an electrifier 25 and a developing unit 26 aligned along the travelling direction of the OPC belt 21. The electrifier 25 corona-charges the surface of the OPC belt 21 in a positive potential, and the developing unit 26 deposits negative-electrified toner on the surface of the positively-electrified OPC belt 21, using a Coulomb force therebetween. Further, the photographic writing head 24 is an embodiment of a transfer-image forming mechanism which exposes the OPC belt 21 to light to reduce the adhesion force of toner T on a transfer image corresponding to an image to be finally formed among the toner uniformly deposited substantially throughout the entire surface of the OPC belt 21 by the developing unit 26. As shown in FIG. 2, the photographic writing head 24 is mounted in close contact with the back surface of the OPC belt 2. The photographic writing head 24 comprises a light emitting diode (LED) assembly 29 having an LED 28 for emitting light in response to a print instruction and a fiber plate 31 connected thereto via a transparent resin member 30. The fiber plate 31 includes a group of optical fibers 32 configured to directly conduct light emitted by the LED 28 to the back surface of the OPC belt 21 and protective glass members 33, 33 sandwichingly supporting the group of the optical fibers 32 from opposite sides thereof. Surfaces of the group of optical fibers 32 and protective glass members 33, 33 are planished into arcuate surfaces to decrease frictional resistances between the OPC belt 21 and themselves. The OPC belt, as shown in FIG. 2, consists of a transparent base film 34 as a support sheet, a transparent hardwearing layer 35 provided at the back of the base film 34 to slidably contact the photographic writing head 24, a transparent electrode 36 provided on the front surface of the base film 34 to lead charges to ground, a carrier generating layer 37 provided on the transparent electrode 36 to produce a negative-potential carrier C at the portion exposed to light from the photographic writing head 24, and a carrier transmission layer 38 provided on the carrier generation layer 37 and positively electrified along the surface portion thereof by the electrifier 25 to move the carrier C generated by the carrier generation layer 37 to the surface portion thereof. This embodiment further uses a transfer unit 39 opposed to the photographic writing head 24 from the surface side of the OPC belt 21 and positioned apart from the surface of the OPC belt 21 by a distance. While a sheet of paper 40 passes through between the transfer unit 39 and the OPC belt 21, the transfer unit 39 electrostatically transfer to the paper 40 the toner T on the transfer image position alone which was reduced in its adhesion force against the OPC belt 21 due to exposure to light by the photographic writing head 24, and forms a toner image on the paper 40. Between the transfer unit 39 and the electrifier 25 along the surface side of the OPC belt 21 are provided sequentially in the travelling direction of the OPC belt 21 a deelectrifier 43 for removing positive electrification along the surface of the OPC belt 21 and a cleaner 42 for removing residual toner from the surface of the OPC belt 21. Along the travelling direction of the paper 40 is provided a fixing unit 41 which fixes the toner image on the paper 40.

Secondly, the deposited toner layer control apparatus 15 is explained below.

Figure 5:
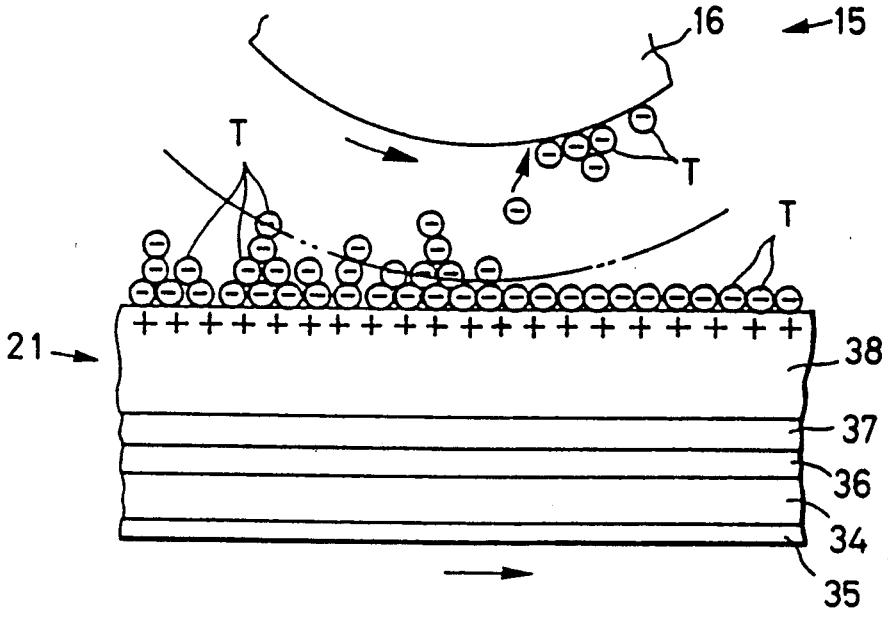
FIG. 5 is a view showing how redundant toner is detached.
Figure 6:
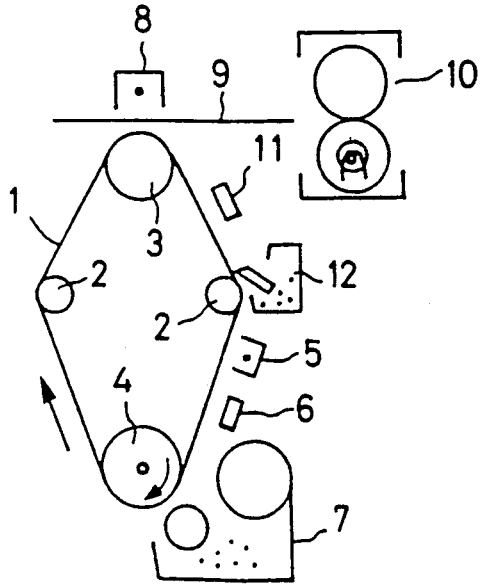
PRIOR ART FIG. 6
FIG. 6 is an entire arrangement view of a prior art system.

This embodiment uses a rotatably supported bias roller 16 used as a bias member which detaches from the OPC belt 21 toner T not necessary for image formation among the negative-potential toner T adhering to the surface of the carrier transmission layer 38 of the OPC belt 21 under a Coulomb force. The bias roller 16, as shown in FIG. 5, is electrified with a positive potential opposite to the toner T. In this embodiment, the bias roller 16 is configured to generate a Coulomb force causing detachment between a single toner layer adhering to the surface of the OPC belt 21 and other toner T outside the single toner layer. The Coulomb force in this embodiment is effective in the range nearer to the bias roller 16 than the two-dot-and-dash line in FIG. 5. Under the bias roller 16 are provided a toner receiver 17 and a toner removal blade 18 slidably contacting the bias roller 16 to remove toner T adhering to the bias roller 16.

Operation of the embodiment is explained below, together with operation of the image forming apparatus.

Upon receipt of a print instruction, the driving roller 23 first rotates in the arrow-marked direction in FIG. 1 to move the OPC belt 21 in the arrow-marked direction, and the toner depositing mechanism deposits toner T on the entire area in the transfer-image forming range on the surface of the OPC belt 21. More specifically, the surface of the OPC belt 21 is positively electrified by a corona-charging action of the electrifier 25, and while the electrified portion passes through the developing unit 26 at the next stage, negatively electrified toner T is deposited uniformly. The toner T is deposited as explained below in detail, referring to FIG. 5. The surface portion of the carrier transmission layer 38, which is the upper most layer of the OPC belt 21, is already electrified with a positive potential due to the corona charging action of the electrifier 25. A Coulomb force generated between the surface portion and the negative-potential toner T causes the toner T to be attracted toward the carrier transmission layer 38 and deposited on the surface of the carrier transmission layer 38. The toner T deposited on the surface of the carrier transmission layer 38 by the toner depositing mechanism does not always form a single layer to be transferred to the paper 40 but often exhibits selective two, three or four layers which causes an uneven deposition.

When the toner layer deposited on the surface of the carrier transmission layer 38 of the OPC belt 21 in this fashion reaches the position of the deposited toner layer control apparatus 15, a Coulomb force is generated between the negative potential of the toner T outside the single-layer toner T directly, uniformly adhering to the surface of the carrier transmission layer 38 and the positive potential of the bias roller 16 so that the toner T outside the single layer is attractedly detached from the surface of the carrier transmission layer 38 by the bias roller 16. As a result, a single-layer toner T consisting of one toner T is formed on the surface of the carrier transmission layer 38 of the OPC belt 21 which passed through the deposited toner layer control apparatus 15. On the other hand, the toner T attracted to the surface of the bias roller 16 is removed therefrom by the toner removal blade 18, and drops on the toner receiver 17 for recovery therein.

After this, as the OPC belt 21 travels, the single-layer toner deposited on the surface thereof reaches the photographic writing head 24 used as a transfer-image forming mechanism. The photographic writing head 24 then emits light selectively toward the OPC belt 21 in order to form a transfer image corresponding to the print instruction. More specifically, the light emitted from the LED 28 of the photographic writing head 24 passes through the transparent resin member 30 and optical fibers 32 and enters in the interior of the OPC belt 21 through the hardwearing layer 35 thereof. The light further passes through the base film 34 and the electrode 36 as shown in arrow a in FIG. 2, and reaches the carrier generation layer 37 to expose the transfer image forming portion of the carrier generation layer 37. In the carrier generation layer 37, a negative carrier C is produced from the light-exposed portion thereof. In the next carrier transmission layer 38, the negative-potential carrier C and a positive-potential charge D at the surface portion pull each other and move in the opposite directions for electrical neutralization. When the positive-potential charge D along the surface of the carrier transmission layer 38 disappears in this fashion, the Coulomb force causing adhesion of the toner T at this portion disappears and changes the toner T at this portion into a transfer image which can be transferred. In the remainder portion which was not exposed, the toner T maintains adhesion to the surface of the carrier transmission layer 38 under a sufficiently large Coulomb force. By the exposure operation of the photographic writing head 24 in this fashion, a transfer image consisting of the toner T having a reduced adhesion force against the OPC belt 21 is formed in the area of the toner T along the surface of the OPC belt 21. This transfer image has an excellent resolution.

Since the image forming apparatus of FIG. 4 includes the transfer unit 39 opposed to the photographic writing head 24, just when the transferable transfer image is formed along the surface of the carrier transmission layer 38 as described above, the negative-potential toner T adhering to the transfer-image position of the carrier transmission layer 38 is attracted toward the transfer unit 39 due to a positive bias voltage thereof, and is transferred to the surface of the paper 40 located midway to form a toner image thereon. Since the toner image on the paper 40 is formed by transferring the transfer image in the original form which was formed along the surface of the carrier transmission layer 38 of the OPC belt 21 under a high resolution, the toner image also maintains a high resolution.

After this, the paper 40 is detached from the OPC belt 21 and transported to the fixing unit 41. After the fixing unit 41 fixes the toner image, the paper 40 is discharged to a discharge tray (not shown).

The OPC belt 21 having passed through the transfer unit 39 is deelectrified while passing through the deelectrifier 43, and is cleaned to remove residual toner adhering thereto while passing through the cleaner 42. All toner taken back by the cleaner 42 may be supplied to the developing unit 26 for a subsequent use.

As described above, since a single-layer toner film consisting of one toner T is formed on the carrier transmission layer 38 of the OPC belt 21 and since the single toner T is transferred to the paper 40, an excellent image under a high resolution is formed on the paper 40.

The aforegoing embodiment is configured to form a single-layered, uniform toner film consisting of one toner T on the carrier transmission layer 38 of the OPC belt 21. However, it may be modified so as to form a multi-layered, uniform toner film consisting of two or more toners on the carrier transmission layer 38, if desired, by employing an arrangement capable of adjusting the distance between the bias roller 16 and the OPC belt 2 or by adjusting the electrification potential of the bias roller 16. Further, when positive-electrified toner T is used, the bias roller may be electrified with a negative potential.

Additionally, the invention may be used in the same fashion in a system using an electrostatic belt, etc. as the toner carrier on which toner T is deposited under a Coulomb force.

Beside this, the invention is not limited to the aforegoing embodiments but may be modified as desired.

Since the inventive image forming method and apparatus are arranged and operates as described above, the sensitized member can be exposed to light so that necessary part alone among the toner deposited on the sensitized member can be transferred, and a high-resolution image can be formed. The exposure unit is never spoiled by toner, and a high-quality print is obtained by effectively using the interior of the sensitized member. Further, the invention simplifies the entire arrangement of an electronic photographic apparatus, etc. to reduce the scale and manufacturing cost thereof.

What is claimed is:

1. An image forming apparatus comprising:

a rotatable endless sensitized member;

an electrifier to electrically charge an entire first surface of said sensitized member with a charge of a first polarity in a first rotation of said sensitized member and electrically charge with a charge of second polarity opposite the first polarity residual toner adhering to the sensitized member in a second rotation of said sensitized member;

a developing unit to deposit toner charged with the second polarity on said first surface in the first rotation of said sensitized member and to remove the residual toner from said first surface in the second rotation;

an exposure unit to expose said sensitized member selectively in the first rotation so as to reduce an adhering force of toner adhered to said first surface thereof located at a transfer image corresponding to an image to be formed on said sensitized member and in the second rotation to expose said first surface so as to remove a residual electrical charge therefrom; and a transfer unit to transfer the toner at the transfer image on said sensitized member to a recording medium in the first rotation;

wherein one image forming process is carried out while said sensitized member is rotated twice.

2. An image forming apparatus according to claim 1, wherein the exposure unit is adjacent to a second surface of said sensitized member opposite to said first surface.

3. An image forming apparatus comprising:

an endless sensitized member;

an electrifier to electrically charge said sensitized member to a first polarity;

a developing unit to deposit toner charged to a second polarity opposite the first polarity on a first surface of said sensitized member;

an exposure unit contacting a second surface of said sensitized member selectively exposing said sensitized member to light so as to reduce an adhering force of toner adhered to said first surface at a position of a transfer image corresponding to an image to be formed, and including a group of optical fibers in a protective member and including light emitting diodes arranged on said member with a surface of said protective member which contacts said second surface being curved; and a transfer unit for transferring toner at the transfer image on said sensitized member to a recording medium.

4. An image forming apparatus comprising:

means for electrically charging an entire surface of a transfer-image forming area of an endless sensitized member during one rotation of said sensitized member;

means for depositing oppositely-charged toner on said electrically-charged surface of the sensitized member under a Coulomb force;

means for reducing the Coulomb force between said sensitized member and said toner at predetermined locations on said transfer-image forming area corresponding to a transfer-image to be formed;

means for transferring said toner having a reduced Coulomb force to a recording medium to form a transfer-image thereon;

means for electrically charging said toner adhering to said sensitized member into an opposite charge during a subsequent rotation of said sensitized member;

means for removing said opposite-charged toner from said sensitized member; and means for neutralizing said charge on said sensitized member.

5. An image forming method comprising:

electrically charging the entire surface of a transfer-image forming area of an endless sensitized member during one rotation of said sensitized member;

subsequently depositing oppositely-charged toner on said electrically charged surface of the sensitized member under a Coulomb force;

subsequently reducing the Coulomb force between said sensitized member and said toner at predetermined locations on said transfer-image forming area corresponding to a transfer-image to be formed;

subsequently transferring said toner having a reduced Coulomb force to a recording medium to form a transfer-image thereon;

subsequently electrically charging said toner adhering to said sensitized member into an opposite charge during a subsequent rotation of said sensitized member;

removing said opposite-charged toner from said sensitized member; and neutralizing said charge on said sensitized member.

6. A deposited tone layer control apparatus comprising:

a toner carrier;

a biasing member opposed to a surface of said toner carrier;

a charging means for charging the biasing member to an electrical charge opposite to an electrical charge of a toner layer adhered to said toner carrier, and for generating a Coulomb force on the toner layer adhered to the surface of said toner carrier by charging said biasing member so as to remove a portion of said toner layer from said surface to form a layer of toner of uniform thickness.

* * * * *